US006779375B1

(12) United States Patent
Alexoff

(10) Patent No.: US 6,779,375 B1
(45) Date of Patent: Aug. 24, 2004

(54) METHOD AND APPARATUS FOR PRODUCING TUBES AND HOLLOW SHAFTS

(76) Inventor: Randall L. Alexoff, 5 Windemere Pl., Poland, OH (US) 44514

( * ) Notice: Subject to any disclaimer, the term of this patent is extended or adjusted under 35 U.S.C. 154(b) by 0 days.

(21) Appl. No.: 10/397,651

(22) Filed: Mar. 26, 2003

(51) Int. Cl.[7] ..... B21C 1/22
(52) U.S. Cl. ..... 72/370.02; 72/283
(58) Field of Search ..... 72/276, 283, 285, 72/291, 370.02, 370.01

(56) References Cited

U.S. PATENT DOCUMENTS

| | | | | |
|---|---|---|---|---|
| 2,228,301 A | | 1/1941 | Ditzel et al. | |
| 2,535,339 A | * | 12/1950 | Woeller | 72/276 |
| 3,572,080 A | | 3/1971 | Alexoff | |
| 4,277,969 A | | 7/1981 | Simon | |
| 4,292,831 A | | 10/1981 | Simon | |
| 4,301,672 A | | 11/1981 | Simon | |
| 4,454,745 A | | 6/1984 | Cudini | |
| 4,487,357 A | | 12/1984 | Simon | |
| 4,616,500 A | | 10/1986 | Alexoff | |
| 4,776,196 A | | 10/1988 | Cudini | |
| 5,205,464 A | | 4/1993 | Simon | |
| 5,213,250 A | | 5/1993 | Simon | |
| 5,241,848 A | | 9/1993 | Simon | |
| 5,320,580 A | | 6/1994 | Simon | |
| 5,522,246 A | | 6/1996 | Simon | |
| 6,439,672 B1 | | 8/2002 | Simon | |

FOREIGN PATENT DOCUMENTS

| | | | | |
|---|---|---|---|---|
| DE | 27 58 136 | * | 4/1979 | 72/283 |
| JP | 58-188510 | * | 11/1983 | 72/283 |

* cited by examiner

*Primary Examiner*—Lowell A. Larson
(74) *Attorney, Agent, or Firm*—Robert J. Herberger

(57) ABSTRACT

A method and apparatus for producing an end connection by which a tube of variable wall thickness can be formed by being drawn between a die and a mandrel. The end of tubular stock is reduced and its wall thickness increased by being extruded into the space between a reducing die and a mandrel located within the tube, the mandrel having a plug that forms the inner surface of the formed tube as the mandrel and die are retraced from the end. A screw thread is formed on the inner surface of the formed tube and is engaged by a screw thread on a pull pin adapted for attachment to an actuating cylinder that applies a force tending to pull the tube through the die and mandrel.

14 Claims, 2 Drawing Sheets

88

METHOD AND APPARATUS FOR PRODUCING TUBES AND HOLLOW SHAFTS

BACKGROUND OF THE INVENTION

1. Field of the Invention

This invention relates to the field of draw forming material, particularly to the art of forcing plastic deformation of metal tube stock in a die to produce formed tubes and hollow shafts.

2. Description of the Prior Art

Various cold-drawing techniques are known for producing tubing and hollow shafts having a wall thickness that is either constant throughout its length or that varies along its length. For example, U.S. Pat. Nos. 2,228,301, and 4,616,500 describe techniques for producing tubes having a relatively large diameter. The technique of the '500 patent relates to a method that works well on large diameter tubing, wherein a removable plug of sufficient size is used to transmit large pulling or tension forces required to draw the tube through a die. However, on smaller diameter applications, such as when forming rear axles for front wheel drive vehicles and twist axles that both connect the rear wheels and serve as a stabilizer bar to control swing of a motor vehicle in turns, the conventional removable plug technique cannot be used effectively because of the relatively small initial size of the workpiece and the small inside diameter of the shaft being formed.

U.S. Pat. No. 3,572,080 describes a method for push pointing workpieces, a technique commonly used on a draw bench for cold working tubes and shafts from tube stock. It is best applied where the workpiece is approximately 6 feet or longer. A principal disadvantage of this technique is the resulting waste of a large amount of material. When drawing lengths of 6 feet or longer, the amount of waste material resulting from use of a pointed tube is insignificant compared to the loss of 5–8 inches on a workpiece that is 10–60 inches long. Therefore, when this technique is applied to an axle that is only 48 inches long, push-pointed tubes can result in waste of approximately 15 percent of the material required to produce them. The technique has a further disadvantage in that a pointed tube tends to collapse when a large tension force is applied to the reduced diameter transition section of the pointed tube.

Draw forming tubing to produce relatively short tubes and hollow shafts of relatively small diameter requires a technique that is compatible with applying relatively large drawing forces to the workpiece in order to produce a tube with a relatively thick wall at each end and a constant thin wall length in the region between the thick wall portions.

A broach puller is sometimes used to form the inside diameter of a tube with grooves such as rifling grooves on the inside diameter of gun barrels. Broach pullers are used to pull rods through a formed tube, restrained against displacement at a plate having an opening. Conventional broach pullers have a spring-loaded puller, which opens when the puller contacts a fixed restraining plate before pulling the broach bar through the tube. When the broach puller strikes the fixed plate, that contact compresses a helical compression spring located in the puller. The spring causes the jaws of the puller to open radially. As the puller is drawn away from the fixed plate, the compression force of the spring causes the radially positioned jaws to close and to engage a recess formed on the pull bar. This mechanism however will not release the pin except upon contact of the broach puller, usually at a fixed plate. In order to facilitate opening the jaws in a location other than that of the fixed plate, another technique is required to open and close the puller so that its jaws can be opened and closed in response to a command or a limit switch setting.

SUMMARY OF THE INVENTION

It is preferable in the process of cold drawing tubes having a variable wall thickness, particularly when the tubes have a small diameter and are relatively short, that a positive mechanical end connection, such as an end connection having engaged screw threads, be used to draw the tube through a reduction die and over a forming mandrel. The present invention provides a method for draw forming a thickened wall portion near an end of the tube, on whose inner surface screw threads are formed. An advantage of the invention is the provision of a reliable mechanical connection between the workpiece and equipment for drawing the tube, which connection requires a small space and provides easy engagement.

It is yet another advantage of the invention to minimize the amount of scrap or waste material that results from draw forming a workpiece to produce a tube or hollow shaft having a small diameter.

It is another advantage of the present invention to open and close the jaws of a gripper or puller on command regardless of its location.

In realizing these advantages, a method for producing a tube or hollow shaft from a workpiece having a tubular opening includes the steps of positioning near an end of the workpiece a reducing die for reducing the size of the outer surface of the workpiece and directing a portion of the workpiece into contact with an inner surface of the die; positioning within the die a mandrel having an outer surface and a plug, the mandrel and die defining a space between the inner surface and outer surface; advancing the die over the workpiece and the mandrel into the tubular opening along a portion of length of the workpiece, causing the workpiece to extrude into the space and to trap the plug behind the portion of the workpiece located in the space; and retracting the die and mandrel from the workpiece so that the plug is pulled along an inner surface of the portion of the workpiece located in the space. Then a screw thread is formed on the inner surface of the relatively thick wall portion of the workpiece.

An apparatus for realizing these advantages by producing an end connection on a workpiece having a tubular opening includes a reducing die having an inner surface formed with a transition section having a conical surface extending between a large diameter end and a small diameter end; and a substantially cylindrical surface having one end located at the small diameter end and extending axially therefrom; and a mandrel located at least partially within the die, having an outer surface formed with a second substantially cylindrical surface, and a plug located at an end of the second cylindrical surface, the plug having a larger diameter than that of the first cylindrical surface, the mandrel and die defining a space therebetween.

DESCRIPTION OF THE PREFERRED EMBODIMENT

Figure 1A:
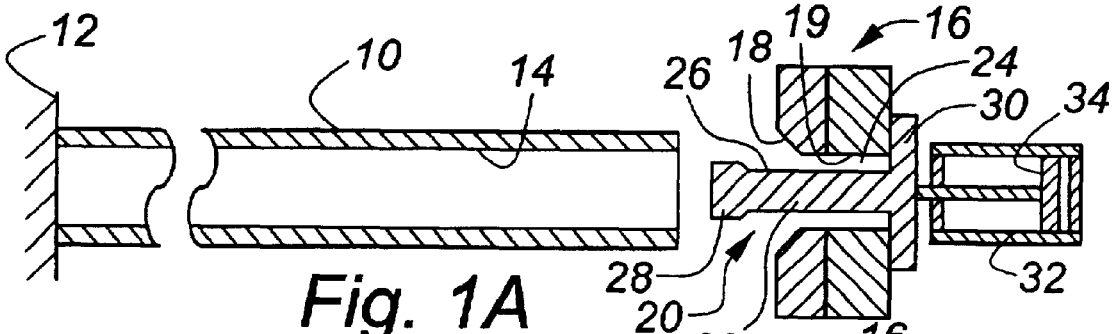
FIGS. 1A–1D illustrate the steps and apparatus for performing the method according to this invention.

With reference now to the drawings and particularly to FIGS. 1A–1D, there is shown a sequence of method steps for forming an end connection on a tube to be formed by a cold drawing process. A workpiece 10 in the form of a circular cylindrical tube, preferably of steel, aluminum, or another material capable of elastic or plastic deformation, is arranged in a horizontal plane and is fixed at one end 12 against longitudinal or axial displacement. For example, the workpiece may be clamped by jaws (not shown) to prevent its axial movement, as described in U.S. Pat. No. 3,572,080. The opposite end of the tube is open. The internal surface of the tube is in the form of a tubular opening 14, usually a circular cylindrical surface.

A reducing die 16, adapted to reduce the size of the outer contour of the workpiece 10, includes a transition surface 18 for directing the wall of the workpiece radially inward, and a surface 19, in the form of a substantially circular cylinder located at the base of the transition surface 18, for establishing the size of the outside diameter of the formed tube.

A mandrel 20 is positioned along the axis of the workpiece and is located at least partially within the die 16. The mandrel includes a body portion 22, whose outer surface 26, in the form of a circular cylinder, is spaced radially from the surface 19 of the die 16. In this way, an annular space 24 is defined and bounded at its outer periphery by surface 19 and at its inner periphery by surface 26. The mandrel is formed also with a plug 28 having an outer circular cylindrical surface, whose diameter is larger than the diameter of the cylindrical surface 26 but smaller than the diameter of surface 19. The mandrel is fixed in position relative to the die, preferably by contact between a flange 30 and the end surface of the die.

The die and mandrel are moved axially as a unit in the configuration of FIG. 1A by an actuating cylinder 32 containing a double acting piston 34, whose displacement within the cylinder results from alternately pressurizing and venting the spaces within the cylinder on opposite sides of the piston. The actuating cylinder is connected to a source of high-pressure fluid, preferably hydraulic fluid or pressurized air.

Figure 1B:
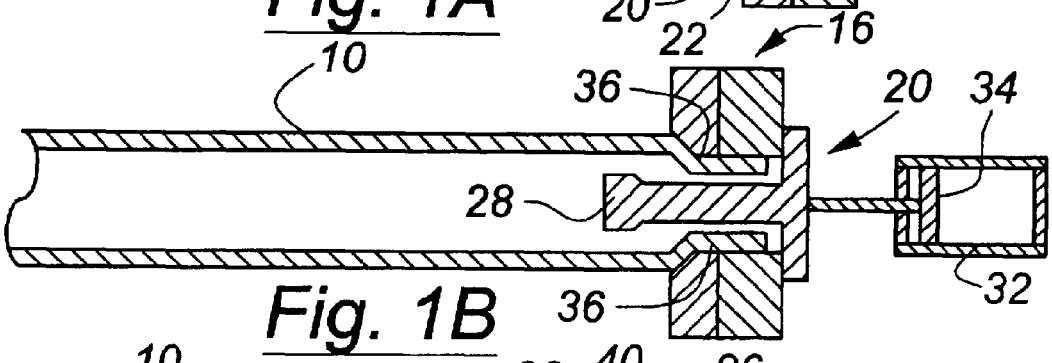

FIG. 1B shows the effect of cylinder 32 having moved the die leftward into compressive contact with the end of the workpiece and the mandrel into the tubular opening 14 of the workpiece. When the reducing die 16 advances over the open end of the workpiece 10, the mandrel enters the tubular opening 14 without contacting the inside wall. As the die advances, it reduces the size of the outer surface of the tube for a predetermined distance along the tube, and forces the wall to deform elastically and plastically into the space 24 between the mandrel and die, thereby increasing the thickness of the wall portion 36 located within the space 24 from the original thickness of the workpiece. After the material of the wall of the tube fills the space 24, plug 28 is trapped against removal in the rightward direction due to its interference with the wall portion 36.

Figure 1C:
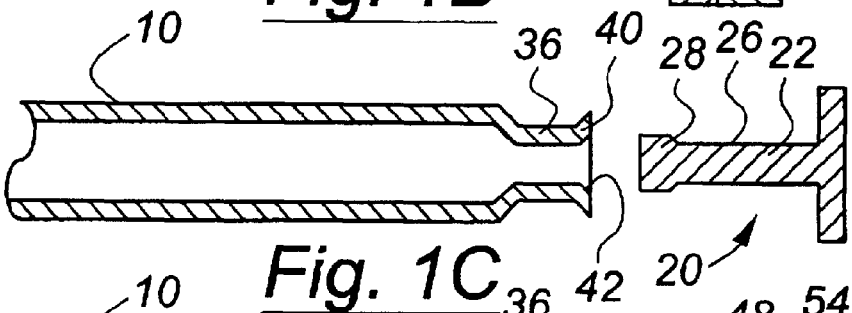

In the next step, cylinder 32 is again pressurized to move the die 16 and mandrel 20 rightward and to retract the die from over the workpiece and the mandrel from within the tubular opening. As the plug passes through the wall portion 36 of the workpiece, it qualifies, establishes or determines the resulting inside shape of the wall portion 36 and the size of its inside diameter. Furthermore, as FIG. 1C shows, when the plug 28 exits the tubular opening, a flare 40 is produced at the right-hand extremity of the workpiece. The inner surface 42 of the flare simulates a chamfer that can be used as a lead to start a tapping tool to enter the tubular opening in order to form screw threads 44 on the inside surface of the wall portion 36.

The size and thread contour of screw thread 44 must be such that the shear strength of the threaded connection to the pull pin 46 (shown in FIG. 1D) is sufficient to transmit to the workpiece the tensile force that draws the tube using a reducing die and mandrel.

Figure 1D:
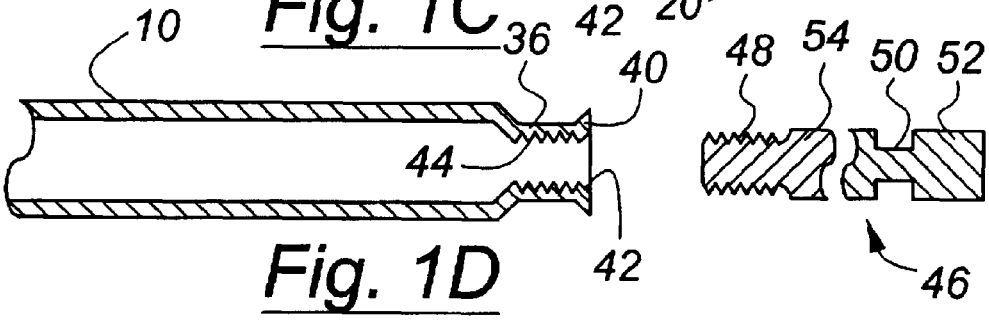

FIG. 1D shows adjacent the workpiece a pull pin 46 having external screw threads 48 adapted to engage threads 44 on the workpiece, a recess 50 located between a head 52, and a shank 54. The workpiece 10 is formed with an end connection or attachment that includes the increased wall thickness portion 36 and screw threads 44 formed on the inner surface of the wall portion surface 36.

Figure 2:
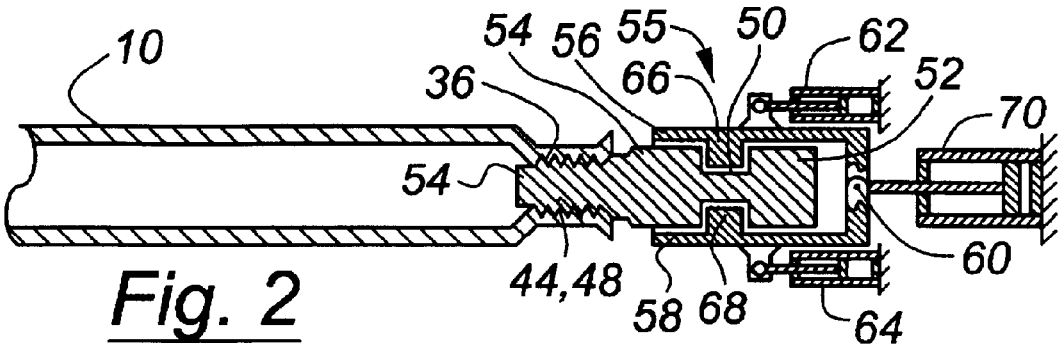
FIG. 2 shows a gripper suited for use in draw forming tubes using this invention.

Referring now to FIG. 2, in operation, a gripper or puller 55 for drawing the workpiece 10 through a reducing die has jaws 56, 58 that open and close causing projections 66, 68, carried on the jaws, to release and engage the recess 50, respectively.

The gripper jaws 56, 58 are pinned at 60 to pivot between a closed position, shown in FIG. 2, and an opened position, in which the jaws are separated in order to receive the head 52, to engage recess 50, and to surround a portion of the shank 54. The jaws open and close in response to the pressurized and vented condition of actuating cylinders 62, 64, which are preferably pneumatically actuated. When the jaws are closed, projections 66, 68 seat within recess 50 and engage the pull pin.

The gripper is connected to a hydraulically actuated cylinder 70, which develops a large tension force during the drawing operation. That force is transmitted by the gripper 55 to the pull pin 46 due to engagement of projections 66, 68 with recess 50, and the force is applied to the end connection of the tube through the engaged screw threads 44, 48.

The force produced by cylinder 70 draws the workpiece 10 through a reducing die and over an internal mandrel, which cooperatively form the tube to its final inner and outer shape and diameter.

When cylinders 62, 64 open the gripper, cylinder 70 or another actuating cylinder is used to push the pull pin leftward, thereby removing the tube and pull pin from the gripper 55.

Figure 3A:
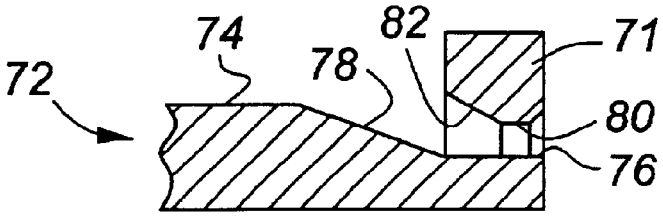
FIGS. 3A–3C illustrate method steps for forming a variable wall thickness tube according to this invention.
Figure 3B:
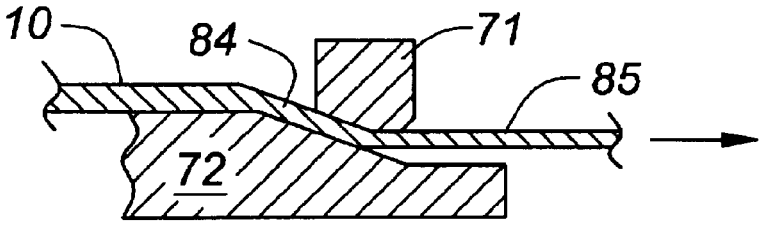
Figure 3C:
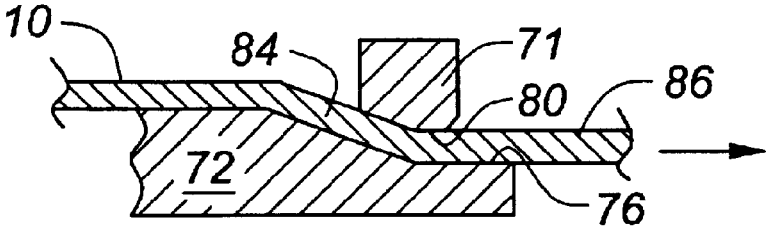
Figure 3D:
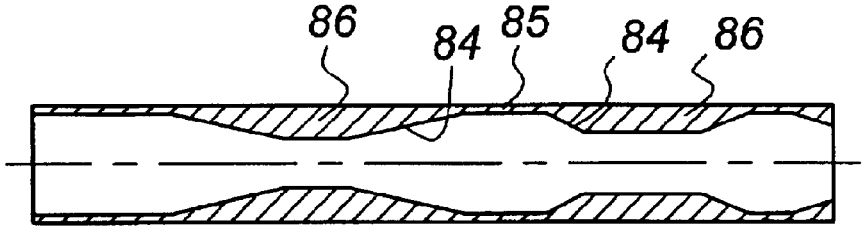
FIG. 3D is a cross section of a tube made with the apparatus and method illustrated in FIGS. 3A–3D.

FIGS. 3A–3C illustrate an arrangement of a reducing die 71 and mandrel 72, which cooperatively form the tubular workpiece 10 into a tube or hollow shaft 88 having a circular cylindrical shape and a wall thickness that varies along the tube's length. A tube 88 formed by the steps of this method is shown in FIG. 3D.

In this arrangement, the mandrel 72 includes a circular cylindrical surface 74 of a relatively large diameter, a circular cylindrical surface 76 of a smaller diameter, and a tapered or transition section 78 located between surfaces 74 and 76.

The length of surface 78 is longer than the transition section of a conventional mandrel used to form variable wall thickness tubing by drawing the tube through a die and over a mandrel. The increased length of surface 78 facilitates producing on the tube being formed a beveled or tapered sections 84 having a closely controlled variable length. Conventionally, the mandrel's contour or profile is relied on to generate the taper of blend areas 84 between the thick wall 86 and thin wall 85 portions of a drawn tube.

The reducing die 71 is formed with a cylindrical inside diameter portion 80, which is used to establish or qualify the constant outside diameter of the formed tube, and a transition section 82, on which the workpiece material is directed and moves radially inward while passing through the die. According to this invention, the inside diameter of the tube being formed can be varied by adjusting the axial or longitudinal position of the reducing die 71 relative to the corresponding position of the mandrel 72 while the workpiece 10 is being drawn through the die.

Although the steps of the method will be described in terms of moving the die relative to the mandrel, it may be more preferable to have mandrel move and the die held stationary.

FIG. 3B shows the die 71 moved leftward from its position in FIG. 3A so that the transition section 78 is surrounded by the die. With the die and mandrel so positioned, a relatively thin wall portion 85 of the tube is produced.

The die 71 is moved longitudinally rightward from the position of FIG. 3B to that of FIG. 3C at a predetermined speed to allow the workpiece material to flow at a given point on the transition section 78 of the mandrel, while drawing the workpiece rightward through the die and over the mandrel. This controlled speed of die displacement produces a controlled length of the blended or tapered section 84 located adjacent the thin wall portion 85.

With the die 71 positioned as in FIG. 3C, section 80 of reducing die 71 overlaps section 76 of the mandrel 72, with the die and mandrel so positioned, the resulting wall thickness is greater than the thickness produced when the die is located as in FIG. 3B. Also the inside diameter of the formed tube is smaller than that produced when the mandrel and die are located as in FIG. 3B.

During the forming method of this invention, a pull pin 46 has its external screw threads engaged with internal threads on the workpiece formed as described with reference to FIGS. 1A–1D. A gripper or puller, preferable that of FIG. 2, and an actuating cylinder attached to the gripper, operate to draw the workpiece rightward through the die 71 and over the mandrel 72, regardless of the position of the mandrel 72 relative to the die.

Figure 4:
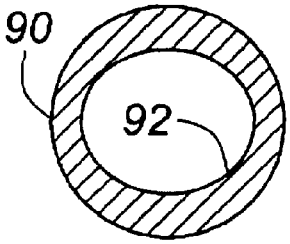
FIG. 4 illustrates a cross section of a tube produced according to this invention in which the mandrel has an elliptical cross section.
Figure 5:
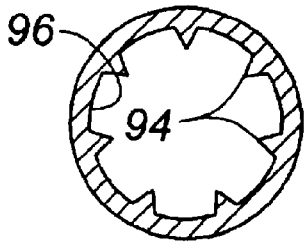
FIG. 5 illustrates a cross section of a tube produced according to this invention in which the mandrel has axially directed slots.

The inner periphery of the finished tube need not be circular. For example, by using a mandrel having an elliptical or oval cross section, the cross section of the tube or shaft formed by the method of this invention will appear as in FIG. 4, wherein the outer surface 90 is a circular cylinder and the inner surface 92 is an elliptical cylinder. By way of another example, the outer surface of the mandrel may have axial or longitudinal slots with tapered sides. The cross section of a tube formed by the method of this invention using such a mandrel has angularly spaced ribs 94 protruding radially inwardly from an inner cylindrical surface 96, as FIG. 5 shows.

Although the invention has been shown in connection with certain specific embodiments, it will be readily apparent to those skilled in the art that various changes in form and arrangement of parts may be made to suit requirements without departing from the spirit and scope of the invention.

Therefore, what is claimed is:

1. A method for producing a tube or hollow shaft from a workpiece having a tubular opening and thickness, comprising the steps of:

positioning near an end of the workpiece a reducing die for reducing the size of the outer surface of the workpiece and directing a portion of the workpiece into contact with an inner surface of the die;

positioning within the die a mandrel having an outer surface and a plug, the mandrel and die defining a space between the inner surface of the die and the outer surface of the mandrel;

advancing the die over the workpiece and the mandrel into the tubular opening along a portion of length of the workpiece, causing the workpiece to extrude into the space and to trap the plug behind the portion of the workpiece located in the space, wherein the thickness of said portion of length is increased;

retracting the die and mandrel from the workpiece so that the plug is pulled along an inner surface of the portion of the workpiece located in the space;

tapping a screw thread on the inner surface of the workpiece using a tapping tool; and engaging the screw thread formed on a pull pin with the screw thread on the inner surface of the workpiece.

2. The method of claim 1, further comprising the steps of:

forming a flair on the end of the workpiece as the mandrel exits the tubular opening during the step of retracting the mandrel;

using the flair to lead the tapping tool into the inner surface of the workpiece during the tapping step.

3. The method of claim 2, further comprising the step of:

engaging the pull pin with a puller having jaws that open and close in response to movement of a piston located in a first actuating cylinder.

4. The method of claim 3, further comprising the steps of:

disengaging the puller from the pull pin by using the first actuating cylinder to open the puller jaws; and using a second actuating cylinder to remove the puller from the pull pin and workpiece.

5. A method for producing a tube or hollow shaft from a workpiece having a tubular opening and thickness, comprising the steps of:

holding the workpiece substantially fixed against longitudinal movement;

positioning near an end of the workpiece a reducing die for reducing the size of the outer surface of the workpiece and directing a portion of the workpiece into contact with an inner surface of the die;

positioning within the die a mandrel having an outer surface and a plug, the mandrel and die defining a space between the inner surface of the die and the outer surface of the mandrel;

forcing the die and the mandrel to move along the workpiece so that a portion of the workpiece enters the space and traps the plug in the tubular opening behind the portion of the workpiece located in the space, whereby the thickness of said portion of the workpiece is increased within the space between the inner surface of the die and the outer surface of the mandrel;

pulling the die and mandrel from the workpiece so that the plug contacts, and is forcibly drawn along an inner surface of the portion of the workpiece located in the space;

tapping the screw thread on the formed inner surface of the workpiece; and engaging and disengaging a screw thread formed on a pull pin with a screw thread on the inner surface of the workpiece.

6. The method of claim 5, further comprising the steps of:

forming a flair on the end of the workpiece as the mandrel exits the tubular opening during the step of retracting the mandrel; and using the flair on the end of the workpiece to lead a tapping tool into the inner surface of the workpiece.

7. The method of claim 6, further comprising the step of:

engaging the pull pin with a puller having jaws that open and close in response to movement of a piston located in a first actuating cylinder.

8. The method of claim 7, further comprising the steps of:

disengaging the puller from the pull pin by using the first actuating cylinder to open the puller jaws; and using a second actuating cylinder to remove the puller from the pull pin and workpiece.

9. Apparatus for producing a tube or hollow shaft with a variable wall thickness from a workpiece, the apparatus comprising:

a reducing die having an inner surface formed with a transition section having a conical surface extending between a large diameter end and a small diameter end, and a section having a first substantially cylindrical surface having one end located at the small diameter end and extending axially therefrom; and a mandrel located at least partially within the die and contacting the die for coordinated movement together with the die along the workpiece, the mandrel having an outer surface formed with a second substantially cylindrical surface surrounded by the die and spaced radially from the die, and having a plug located at an end of the second cylindrical surface the plug being spaced axially outside the inner surface of the die to accommodate flaring of the end connection; and a driving means for producing a force to the die and mandrel, tending to move the die over the outer surface of the workpiece and the mandrel into and out of the tubular opening along a portion of length of the workpiece to form a flared end connection on the workpiece.

10. The apparatus of claims 9, further comprising:

a pull pin having a screw thread adapted to engage a screw thread formed on the flared end connection of the workpiece.

11. The apparatus of claim 10, further comprising an actuating cylinder to driveably engage the pull pin and produce a force tending to move the workpiece axially.

12. The apparatus of claim 9, further comprising:

a pull pin having a screw thread adapted to engage a screw thread formed on the flared end connection of the workpiece, and the pull pin having an engageable recess;

a puller having jaws mounted to engage and disengage the recess; and an actuating cylinder connected to the puller, producing a force in opposite directions alternately to engage and to disengage the pull pin.

13. The apparatus of claim 9, further comprising:

a pull pin having a screw thread adapted to engage a screw thread formed on the flared end connection of the workpiece, the pull pin having an engageable recess;

a puller having jaws mounted to engage the recess and to disengage the recess;

an actuating cylinder connected to the puller, producing a force in opposite directions alternately to engage and to disengage the pull pin; and wherein the actuating cylinder is attached to the puller and applies to the pull pin a force tending to move the pull pin and workpiece while the puller jaws are closed.

14. The apparatus of claim 9, wherein the driving means is an actuating cylinder for producing the force applied to the die and mandrel.

* * * * *